US008152443B1

(12) United States Patent
Pemberton

(10) Patent No.: US 8,152,443 B1
(45) Date of Patent: Apr. 10, 2012

(54) SELF-PRIMING CENTRIFUGAL PUMP FREE OF MECHANICAL SEALS

(75) Inventor: Steve Pemberton, Gautier, MS (US)

(73) Assignee: Fast Flow, LLC, Gautier, MS (US)

( * ) Notice: Subject to any disclaimer, the term of this patent is extended or adjusted under 35 U.S.C. 154(b) by 1258 days.

(21) Appl. No.: 11/897,472

(22) Filed: Aug. 30, 2007

Related U.S. Application Data

(63) Continuation-in-part of application No. 11/222,095, filed on Sep. 8, 2005, now Pat. No. 7,442,003, which is a continuation-in-part of application No. 10/672,175, filed on Sep. 26, 2003, now Pat. No. 6,942,448.

(51) Int. Cl.
*F04D 9/02* (2006.01)
*F04D 29/44* (2006.01)

(52) U.S. Cl. ..... 415/56.1; 415/71; 415/72; 415/74; 415/75; 415/98; 415/102; 415/143; 415/204; 415/206; 415/214.1

(58) Field of Classification Search ..... 415/56.1, 415/71, 72, 74, 75, 98, 102, 103, 143, 204, 415/206, 213.1, 214.1
See application file for complete search history.

(56) References Cited

U.S. PATENT DOCUMENTS

| | | | | | |
|---|---|---|---|---|---|
| 367,564 | A * | 8/1887 | Wade et al. | 415/74 |
| 1,213,461 | A * | 1/1917 | Cooper | 415/74 |
| 1,586,978 | A * | 6/1926 | Dorer | 415/99 |
| 1,893,445 | A * | 1/1933 | Rimele | 73/861.86 |
| 2,393,127 | A * | 1/1946 | Summers | 415/98 |
| 3,176,621 | A * | 4/1965 | Phillips | 415/72 |
| 3,817,653 | A * | 6/1974 | Onal | 415/74 |
| 3,910,715 | A * | 10/1975 | Yedidiah | 415/182.1 |
| 3,935,833 | A * | 2/1976 | Onal | 440/47 |
| 4,518,311 | A * | 5/1985 | Dernedde et al. | 415/102 |
| 4,688,987 | A * | 8/1987 | Ericson et al. | 415/97 |
| 6,942,448 | B1 * | 9/2005 | Pemberton | 415/102 |
| 7,442,003 | B1 * | 10/2008 | Pemberton | 415/102 |
| 2003/0059293 | A1 * | 3/2003 | Chancey | 415/56.1 |

* cited by examiner

*Primary Examiner* — Christopher Verdier
(74) *Attorney, Agent, or Firm* — John Lezdey

(57) ABSTRACT

A centrifugal pump mounted in an external housing. The pump has a split housing containing an impeller with outwardly extending vanes that is mounted on a drive shaft. The drive shaft at one end is mounted to a sealed bearing within the external housing and at the other end to a drive.

8 Claims, 4 Drawing Sheets

SELF-PRIMING CENTRIFUGAL PUMP FREE OF MECHANICAL SEALS

RELATED APPLICATIONS

This application is a Continuation-in-Part of application Ser. No. 11/222,095 filed Sep. 8, 2005 of Pemberton, now U.S. Pat. No. 7,442,003 which is a Continuation-in-Part of application Ser. No. 10/672,175 filed Sep. 26, 2003 now U.S. Pat. No. 6,942,448.

FIELD OF THE INVENTION

The present invention relates to centrifuged pumps which can be used to fulfill the need to move or remove water or sludge from different locations. More particularly there is provided a fast flow pump having a double intake design that takes suction from both sides of the impeller. The impeller has outwardly extending blades or vanes.

BACKGROUND OF THE INVENTION

U.S. Pat. No. 4,688,987 to Ericson et al discloses a centrifugal pump having a split sloped impeller which is mounted directly to an existing drive shaft. The inner surfaces of the hub portions of the split impeller are knurled or otherwise provided with ridges as to lock the hub against the drive shaft when the two portions of the impeller are clutched together.

This prior centrifugal pump is particularly adapted for use in the engine compartment or hull of a marine vessel wherein the impeller is attached for rotation with the drive shaft, such as a propeller drive shaft, and wherein the pump housing is mounted so as to be in a surrounding and spaced relationship to the impeller blades and drive shaft. The sloped impeller is freely rotatable in order to pump fumes, solids, or fluids through annular intake openings in the pump housing and deliver the same through an outlet formed in the pump housing. The present invention does not have a sloped impeller and does not require balancing.

U.S. Pat. No. 5,051,071 to Haentjens discloses a split impeller centrifugal pump for mounting on an existing drive shaft. The pump has opposed annular inlets. The pump does not contain vanes but grooves and air ducts.

It is an object of this invention to provide a centrifugal pumping apparatus for use in an environment wherein liquids, gases, or slurries may be encountered and wherein the pump is structured so that the impeller is not journaled or directly mounted to a pump housing. In this manner, there is no thrust load problems during the rotation of the impeller by friction between the impeller and the housing as is the case in a pump which the impeller is directly carried by the pump housing.

It is also an object of the present invention to provide a centrifugal pump apparatus which does not require the lubrication and maintenance associated with conventional centrifugal pumps.

It is another object of the invention to provide an improved pump having a high flow rate.

SUMMARY OF THE INVENTION

According to the present invention there is provided a centrifugal pump apparatus which pumps flowable materials, runs wet or dry, and pumps forward or in reverse.

The apparatus comprises an external housing having an opening to allow flowable materials to pass, a split pump housing mounted within said external housing. The pump housing has front and rear walls, peripheral side walls and a pair of opposing fluid inlet openings which provides equal pressure from both sides to an impeller. An impeller having outwardly extending vanes is mounted on a drift shaft which is connectible to a motor. The impeller is mounted within and in spaced relationship with the pump housing. The external housing has bearing means on which the drive shaft is mounted. Accordingly, the impeller and housing cooperate to discharge different types of materials in response to the rotation of the drive shaft.

According to one embodiment of the invention, the pump housing comprises front and rear wall portions, a pair of opposing fluid inlet openings in said front and rear walls of said housing providing equal pressure from both sides on the impeller means. The pump housing is provided with two sections in which each is provided with a fluid inlet opening and a central opening for a drive shaft in at least one section of the housing to provide for a drive shaft that is connectable to a motor means.

According to another embodiment of the invention, there is provided a fluid immersible self-priming discharge pump for removing a fluid such as water and sludge from a container land or vessel or body of water. The discharge pump comprises an outer housing, a pump housing within said outer housing with means for connection to a motor and a bladed impeller. A drive shaft is within the two housing mounted on bearing means and operatively connected for rotation by a motor. An impeller associated with the drive shaft and rotatable within the pump housing so as to draw fluid under equal pressure into the pump housing through inlet openings in the pump housing and pass it along so as to discharge the fluid through the outlet openings by means of impeller blades. Advantageously, the outer housing comprises a vacuum box.

According to another embodiment of the invention, there is provided a fluid self priming discharge pump for removing a flowable material or fluid such as water from a container or vessel. The discharge pump comprises means for connection to a hydraulic motor, an external housing, a closed pump housing forming a vacuum box mounted in said external housing wherein the pump housing has at least two opposite fluid inlet openings which create substantially equal pressure on opposing sides of the impeller. A drive shaft is mounted for rotation on bearing means held by the housing and operatively connected for rotation by a motor. An impeller means is associated with the drive shaft and rotatable within the pump housing so as to draw fluid under equal pressure into the housing through the inlet openings and pass it along the outwardly extending vanes or blade surfaces so as to discharge the fluid through the outlet openings by means of the impeller blades. Since the impeller is not mounted on bearing means it does not clog. A hose or nozzle is associated with the outlet opening to carry the discharge fluid away. The outlet being about 4 inches in diameter and the vacuum box has a suction hose of about 2 inches in diameter to provide a fast flow. The means for activating the motor can be in the form of a hydraulic pump which is located at a separate area, for example, outside of the vessel or container or on another boat.

Advantageously, the pumps of the invention are provided with a drive shaft utilizing Archimedes type auger screws to feed flowable material into the annular inlets of the pump housing.

DESCRIPTION OF THE PREFERRED EMBODIMENTS

A more complete understanding of the invention will be had by referring to the following description and claims of a preferred embodiment, taken in conjunction with the accompanying drawings, wherein like reference members refer to similar parts throughout the several views.

Figure 1:
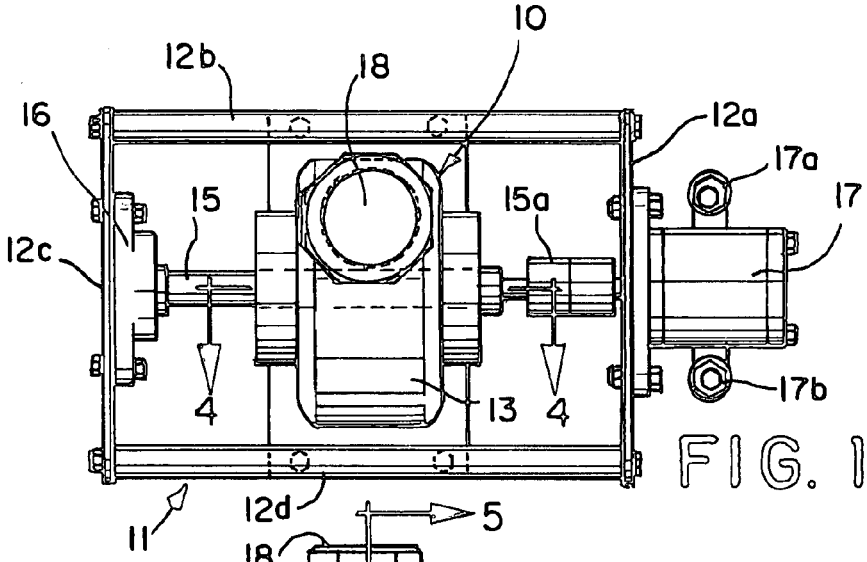
FIG. 1 is a top plan view of a pump of the invention in a vacuum box.

As shown in FIG. 1, a pump (10) of the invention is provided in an enclosed box (11) with the top cover (not shown) removed. Each of the walls 12*a*, 12*b*, 12*c*, 12*d* with the cover result in a vacuum box when filled with liquid (not shown). The pump (10) has a pump housing (13) in which an impeller (not shown) is mounted on a drive shaft (15). The drive shaft (15) on one side is associated with a sealed bearing (16) that is attached to wall 12*c*.

The drive shaft (15) on the other side is coupled with coupling 15*a* to a connection (17) for a motor. The connection (17) for purpose of illustration is a connection for a hydraulic motor (not shown). The connection (17) has attachment means 17*a*, 17*b* for hoses of a hydraulic motor.

The box (11) has a suction hose (not shown) which leads from the outside of the box (11) to the inside for sucking liquid into the box (11). The suction hose diameter is preferably about 4 inches while a discharge hose attached to the discharge opening (18) which protrudes through the top cover has a hose diameter of about 2 inches.

Accordingly, the annular inlet-double suction pump can be installed within a sealed container box with external suction and discharge hose connections. The double suction impeller acts as a strong fan which pulls a 20+ vacuum and then the pump self primes and begins pumping.

The annular vacuum pump can be powered by hydraulic motor, electrically, or with a direct drive shaft from an engine utilizing a sealed drive shaft system.

The hydraulic model is powered from remote engine HPU (hydraulic power pump unit) that has a hydraulic motor that powers the annular inlet pump. The hydraulic motor is mounted external to the box and a drive shaft which runs through a shaft seal to the pump.

The container box will not be submerged in fluid. This could be considered a closed loop suction and in-line piping system for discharge.

Once primed the pump can pull 10 feet or more vertical head pressure. The small 2" hose will flow 400 GPM or more and produce 120 psi discharge pressure. The suction hose size is usually twice the diameter of the discharge (4 inches) and a 2 inch discharge hose just like the double inlet ratio used on the annular inlet openings.

The annular high speed impeller produces a vacuum which allows the pump to self prime. The box has a Cam lock hose quick connections for suction and discharge. The pump box (11) might require filling before pumping but once filled the box (11) will self prime and pull 20+ inches of vacuum.

The vacuum box can self prime and can be utilized as a puddle pump, an in-line booster pump, and has suction hose connection. The ability to suck the last 6 inches from tanks is important. It could replace the diaphragm pumps and do the whole job using hydraulic systems.

This system is ideal for barge pumping and many applications including forestry fire fighting. The direct drive engine shaft runs to the pump and is coupled to the impeller which allows for light weight.

A Kohler gasoline engine 30hp can be used with a direct shaft drive to the annular inlet pump inside the sealed box. The little system will produce 400 GPM, 120 PSI discharge pressure, and 270 vertical feet of head. Two of these systems can fit into a pick up truck, an ideal forest fire fighting system. It shoots stream of water 100' long out from nozzle and delivers lots of water.

Figure 2:
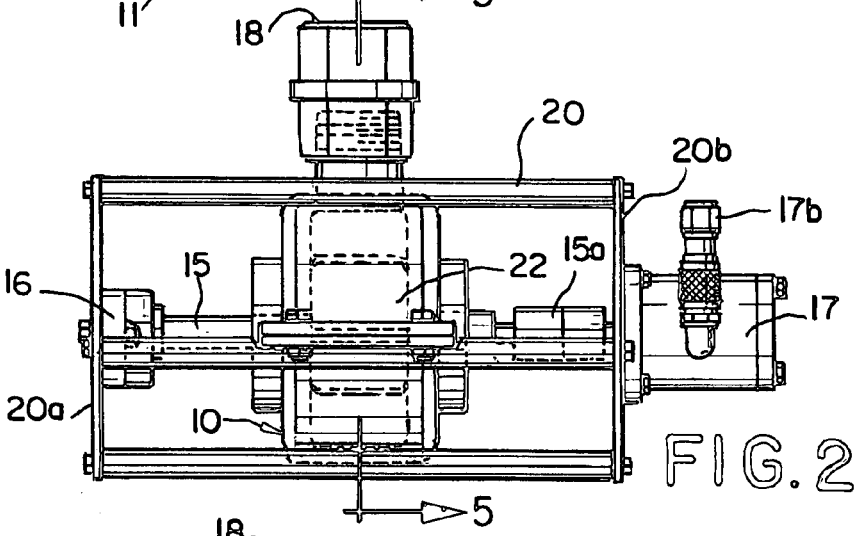
FIG. 2 is front view of a submersible pump of the invention with open sides of an external housing.
Figure 3:
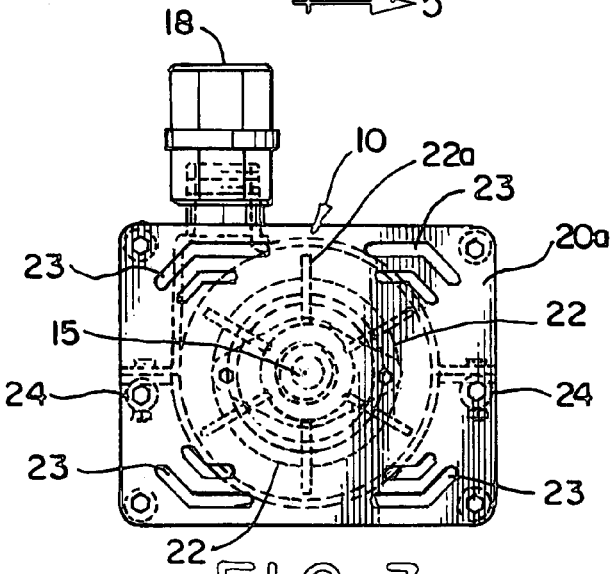
FIG. 3 is a side view of the pump of FIG. 2.

FIGS. 2 and 3 illustrate the pump (10) of FIG. 1 in an open housing (20) so it can be submerged in a flowable material. Mounted on the drive shaft (15) is an impeller (22). The drive shaft (15) is associated with the sealed bearing (16) mounted on the side wall (20*a*). On the opposite side wall (20*b*) is mounted a connection (17) to a motor through coupling (15*a*). The drive shaft (15) and the impeller (22) with vane (22*a*) do not touch the housing so that there is no friction developed.

The fluid enters the pump housing through openings around the shaft (15). Side plate (20) has openings (23) to allow water to enter as well as openings on all sides to maintain equal pressure.

Figure 4:
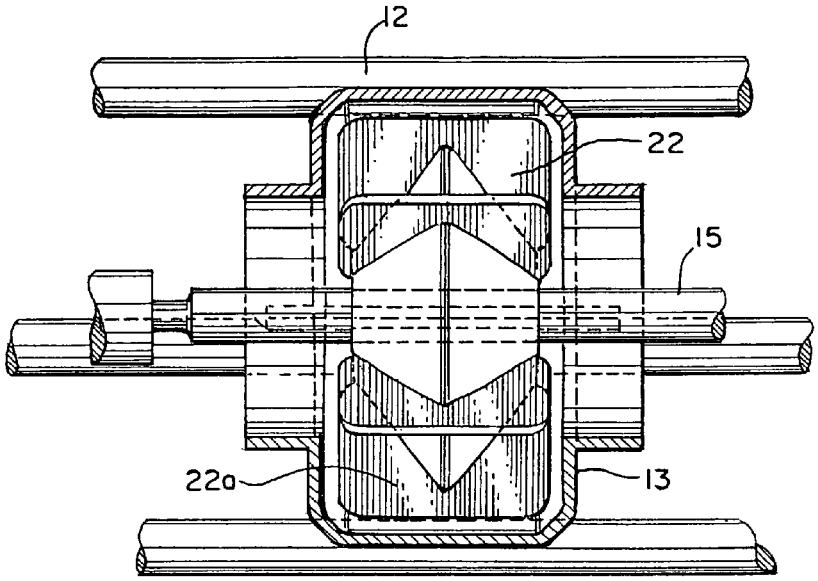
FIG. 4 is a view taken along section 4-4 of FIG. 1.

FIG. 4 is a view taken along section 4-4 of FIG. 1 wherein it will be seen that the impeller (22) and shaft (15) do not touch the pump housing (10).

Figure 5:
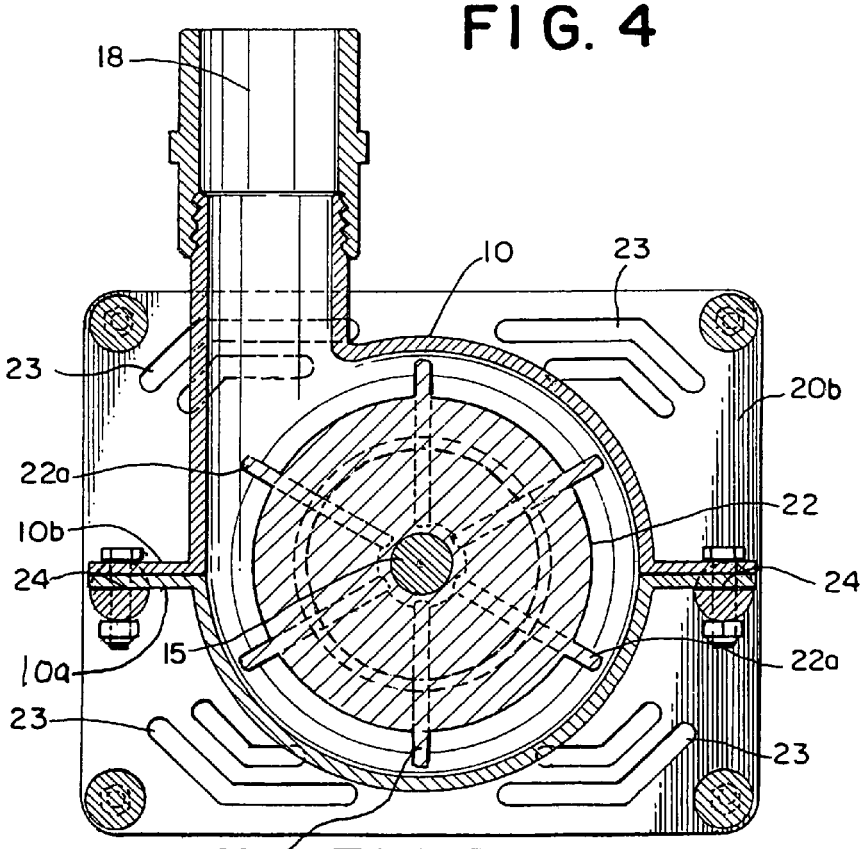
FIG. 5 is a view taken along section 5-5 of FIG. 2.

FIG. 5 is a view taken along section 5-5 of FIG. 2. As shown in the drawing, the pump housing (10) is split into two parts (10*a*, 10*b*) which are bolted together at (24).

Figure 6:
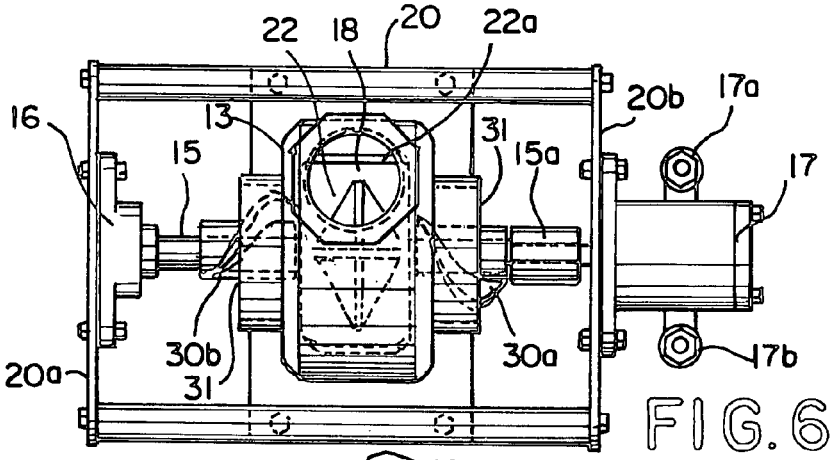
FIG. 6 is a top plan view of an immersible pump of the invention with auger screws.

FIG. 6 is a top plan view of a pump similar to that of FIGS. 1 and 2 except that the drive shaft (15) is provided with right and left auger screws (30*a*, 30*b*) to feed flowable material through openings (31) to the impeller (22). The auger screws (30*a*, 30*b*) drive thick flowable material such as grain, mud, oil spills, etc. to flow into the pump housing. Cutting means may be provided to shred articles such as leaves, paper, twigs, and the like which may clog the impeller.

Figure 7:
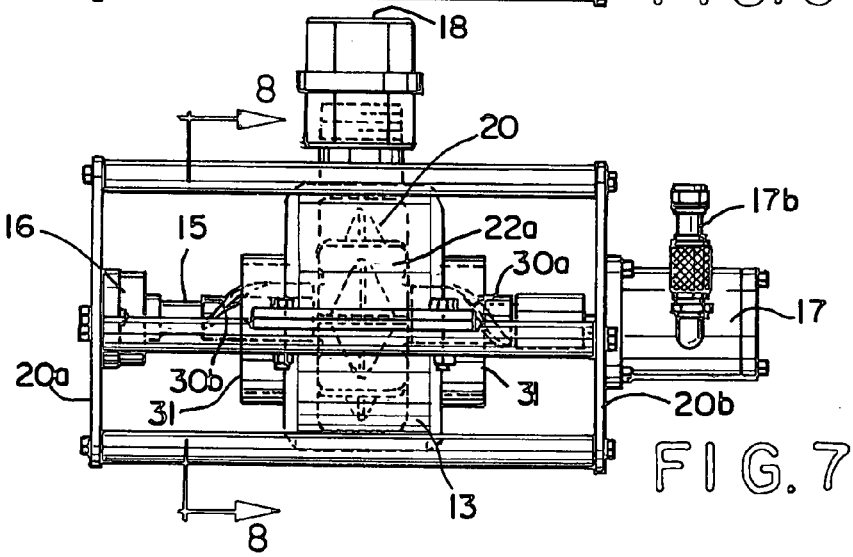
FIG. 7 is a front view of the pump of FIG. 6.

FIG. 7 is a front view of the pump of FIG. 6 which shows the auger screws (30*a*, 30*b*) within the pump housing (13). The auger screws (30*a*, 30*b*) are effective to carry flowable material into the housing such as mud, grain, oil, and the like.

Figure 8:
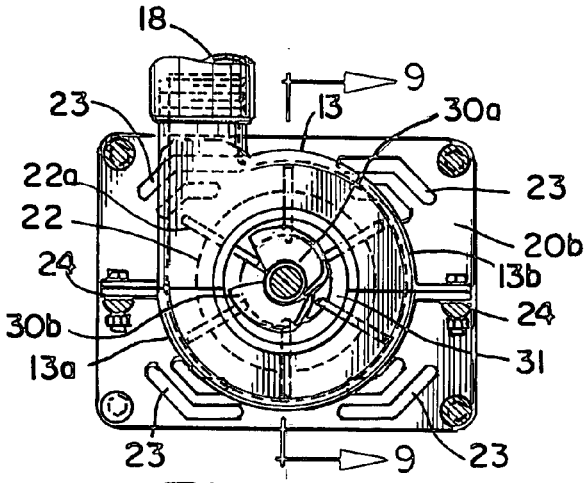
FIG. 8 is a section view of the pump of FIG. 7 taken along section 8-8.

FIG. 8 is a section view of the pump of FIG. 7 taken along section 8-8. The auger screws (30*a*, 30*b*) carry the flowable material to the vanes (22*a*) to discharge through opening (18) which normally is attached to a discharge hose of about 2-4 inches.

Figure 9:
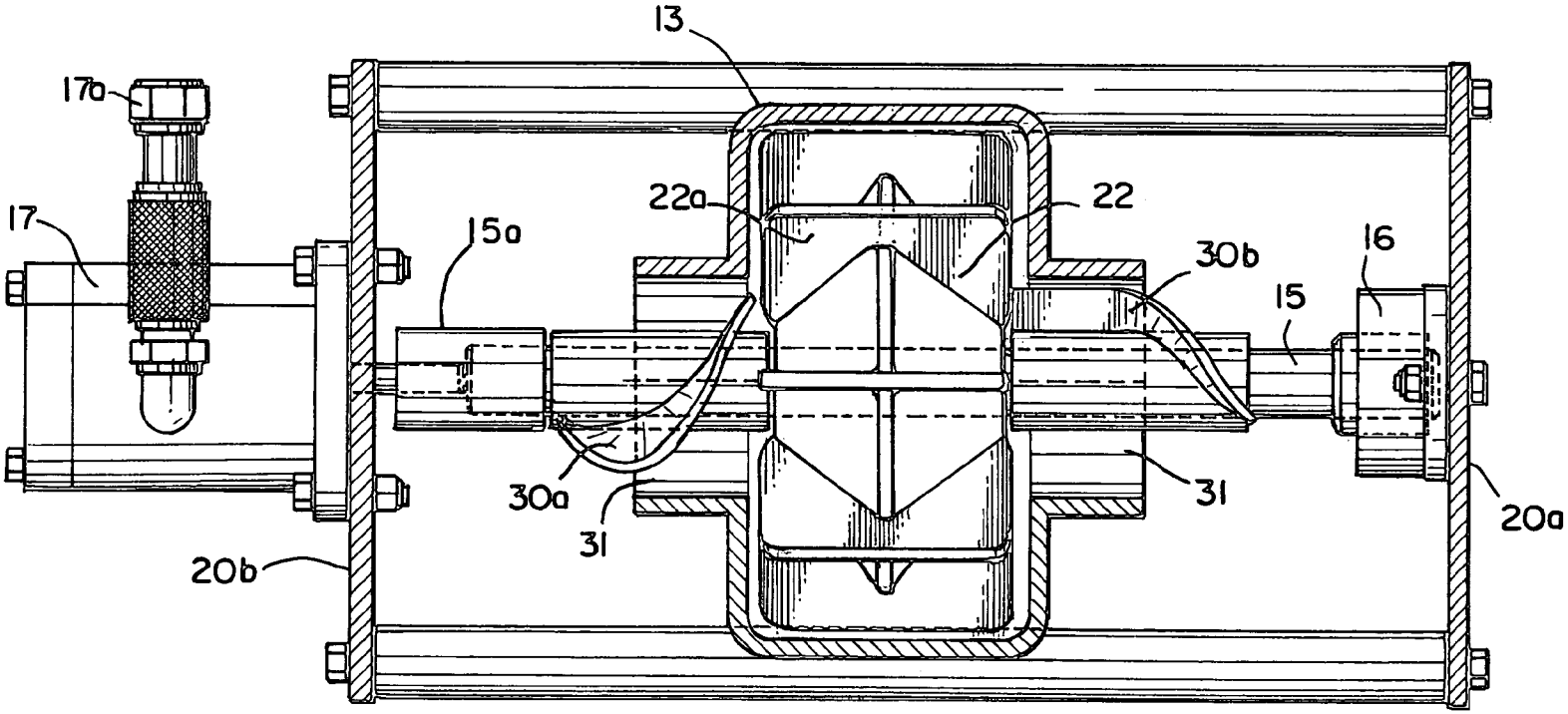
FIG. 9 is a section view of the pump of FIG. 8 taken along section 9-9.

FIG. 9 is a section view taken along section 9-9 of FIG. 8 which shows the auger screws 30*a*, 30*b* extending from without the pump housing (13) to within.

The double suction centrifugal pump can utilize Archimedes style auger screws to help "feed solids, heavy oil, or fluidized materials" into the annular inlet centrifugal pump. The annular inlet pump has left and right hand rotary screw augers that are attached to each side of the impeller. The auger screw extends outside the pump housing case and runs to the centrifugal impeller which is internal to the pump housing.

The pump can also include "cutter head or digging tines" which are attached to both sides of the pump suction annular inlets to help feed solids into the pump. These cutter heads create an agitator action which loosens heavy solids such as drilling mud and other viscous products. This enables the double screw pump to be used as a portable dredge.

The pumps can be hydraulic driven, direct shaft driven from a gasoline or diesel engine, or electrically shaft driven.

A drive shaft runs thru both sides of the annular inlet pump. Also, the pump has no wear plates and it has no mechanical seals internal to the pump.

The double inlet pump impeller with "annular rotary screws" and "centrifugal impeller" has no contact with the pump case or housing. It is held in place by a drive shaft which runs through both sides of the pump inlets to an external shaft bearing. Not having internal mechanical seals and wear plates reduces friction inside the pump, and the double suction design allows passage of solids and heavy fluids with minimal erosional damage.

The double annular inlet design operates on the principal of equal differential pressure across the pump impeller which eliminates thrust load.

The pump has no mechanical wear plates and has no mechanical seals internal to the pump.

The drive shaft, centrifugal impeller and rotary screws have no physical contact with the pump case housing.

The double suction pump impeller can have a curved, double voluted, tapered, or straight vane style blades.

The auger screw extends outside the pump housing and runs to the impeller internal to the pump housing.

The centrifugal impeller with double rotary screws or vanes can be coated with a "ceramic epoxy coating" to extend the life of the pump.

Moreover, agitation screw auger or screw cuter heads that are installed on each side of pump impeller inlets can agitate solid substances continuously at high concentration. The double screw effectively feeds oil, sand, sludge and other fluidized solids into the double inlet centrifugal pump.

The pump and components can be manufactured from aluminum, steel, metal alloy, or composite plastics.

The submersible double screw centrifugal pump feeds both sides of pump inlets, and can be equipped with auger screws for the purpose of agitation and prevention of clogging the suction strainer.

It is, therefore, possible to agitate precipitated substances on the bottom of water such as sand, scale, sludge and black sludge and pump those substances up continuously at high concentration.

What is claimed is:

1. A self-priming centrifugal pump apparatus for removing flowable material which pumps forward or in reverse and can run dry comprising:

a) an external housing comprising a vacuum box with a suction inlet to receive said flowable material, b) a split pump housing having a front wall and a rear wall, a discharge outlet opening in a top portion and opposing inlet means on opposite sides of the pump housing which creates equal pressure from both sides on an impeller, said pump housing mounted in said external housing, c) said impeller being mounted on a driveshaft within and in spaced relationship with said pump housing, said impeller having outwardly extending blades for movement of flowable material outward to the discharge outlet, d) said drive shaft being mounted on sealed bearing means in said external housing and connectable to a motor means, said drive shaft contains left and right hand rotary screw augers to feed fluidized material into the pump housing from opposite sides, said augers extending from within to without the pump housing, said impeller and pump housing cooperating to discharge flowable material through said discharge outlet opening in response to rotation of said impeller, said pump being free of internal mechanical seals and wear plates integral to said pump.

2. The centrifugal pump of claim 1 wherein said drive shaft extends through fluid inlet openings in said pump housing.

3. The centrifugal pump of claim 1 wherein said motor means is associated with said external housing operatively connected to said drive shaft.

4. The centrifugal pump of claim 1 which comprises a 4 inch diameter suction inlet and a 2 inch diameter discharge outlet having a flow rate of 400 GPM.

5. A self-priming immersible centrifugal pump for use with liquids and solids which pumps forward or in reverse comprising an external housing comprising a vacuum box with a suction inlet and having side openings, a drive shaft, means for driving said drive shaft, a split pump housing within said external housing having an impeller on said drive shaft in spaced relationship within said pump housing, said impeller having outwardly extending blades, inlet means in said pump housing on opposite sides of said pump housing around said drive shaft so that there is equal pressure on both sides of the impeller, and outlet means for discharging liquids and solids in response to rotation of said impeller, said pump being free of mechanical seals and wear plates internal to said pump, said drive shaft having auger screws extending from without the pump housing to within.

6. The centrifugal pump apparatus of claim 5 wherein said pump housing comprises front, rear and side wall portions, a pair of aligned fluid inlet openings in said front and rear walls of said pump housing, each of said fluid inlet openings being of a greater dimension than the cross sectional dimension of the drive shaft.

7. The centrifugal pump apparatus of claim 5 wherein said drive shaft extends through fluid inlet openings in spaced non-contacting relationship to said pump housing so that fluids entering said external housing pass around said drive shaft substantially equally on both sides of said impeller and through said outlet means and in which said outlet means is formed in a side wall of said pump housing.

8. The centrifugal pump apparatus of claim 5 wherein said drive shaft is coupled to bearing means on one side of said external housing and is coupled on the other side of said external housing to a said motor means.

* * * * *